United States Patent [19]

Hayashida

[11] Patent Number: 4,488,018

[45] Date of Patent: Dec. 11, 1984

[54] MINIATURE SWITCH

[75] Inventor: Kenji Hayashida, Muko, Japan

[73] Assignee: Hosiden·Electronics Co., Ltd., Osaka, Japan

[21] Appl. No.: 549,712

[22] Filed: Nov. 8, 1983

[30] Foreign Application Priority Data

Dec. 6, 1982 [JP] Japan ..... 57-185235[U]

[51] Int. Cl.[3] ..... H01H 21/00; H01H 1/12; H01H 13/70

[52] U.S. Cl. ..... 200/6 R; 200/16 F; 200/276

[58] Field of Search ..... 200/1 A, 5 R, 5 E, 5 EB, 200/6 R, 6 B–6 BB, 6 C, 8 R, 8 A, 16 F, 67 DA, 67 DB, 159 A, 254, 275, 276, 282, 283, 303

[56] References Cited

U.S. PATENT DOCUMENTS

| | | | |
|---|---|---|---|
| 2,835,753 | 5/1958 | Lewis, Jr. | 200/5 EB |
| 2,835,754 | 5/1958 | Lewis | 200/5 EB |
| 3,244,847 | 4/1966 | Erpel | 200/276 X |
| 3,433,914 | 3/1969 | Ericsson | 200/159 A |
| 4,169,974 | 10/1979 | Peers-Trevarton | 200/276 |
| 4,361,738 | 11/1982 | Meier | 200/276 X |
| 4,384,177 | 5/1983 | Kakuta | 200/276 X |

FOREIGN PATENT DOCUMENTS

| | | | |
|---|---|---|---|
| 555341 | 3/1957 | Belgium | 200/276 |
| 2284966 | 4/1976 | France | 200/276 |

*Primary Examiner*—J. R. Scott

*Attorney, Agent, or Firm*—Pollock, Vande Sande and Priddy

[57] ABSTRACT

When an actuator held in a body of an insulating material is activated, one of arms of a conductive torsion spring in the body is displaced towards the other arm. By this displacement, the arm is inserted between contact portions of a pair of leg pieces of a conductive clip disposed between the actuator and the coil portion of the torsion spring, by which a terminal connected to the other arm and a terminal connected to the clip are connected via the torsion spring.

14 Claims, 13 Drawing Figures

MINIATURE SWITCH

BACKGROUND OF THE INVENTION

The present invention relates to a switch which is large in the stroke of an actuator but requires less force for operating it and which can be miniaturized.

It has been proposed to detect the state of a cassette tape by sensing whether an opening made in a video tape cassette is closed or open. For such detection, it is desirable to use a switch which is small and light in operation and large in stroke and which is inexpensive and highly reliable but conventional switches do not satisfy these requirements altogether.

SUMMARY OF THE INVENTION

It is therefore an object of the present invention to provide a switch which is large in stroke, for example, 2 mm or more and small in operation force, for instance, under 20 g and which can be miniaturized.

According to the present invention, a torsion spring is used and an actuator is engaged with the free end portion of one of its arms. This arm is moved towards the other arm and, at this time, it makes resilient contact with a contact piece, for example, a clip which is disposed between the actuator and the base portion of the torsion spring. Terminals electrically connected to the contact piece and the other arm, respectively, are electrically connected to each other via the torsion spring.

DESCRIPTION OF THE PREFERRED EMBODIMENTS

A description will be given, with reference to the drawings, of an embodiment of the present invention.

Figure 1:
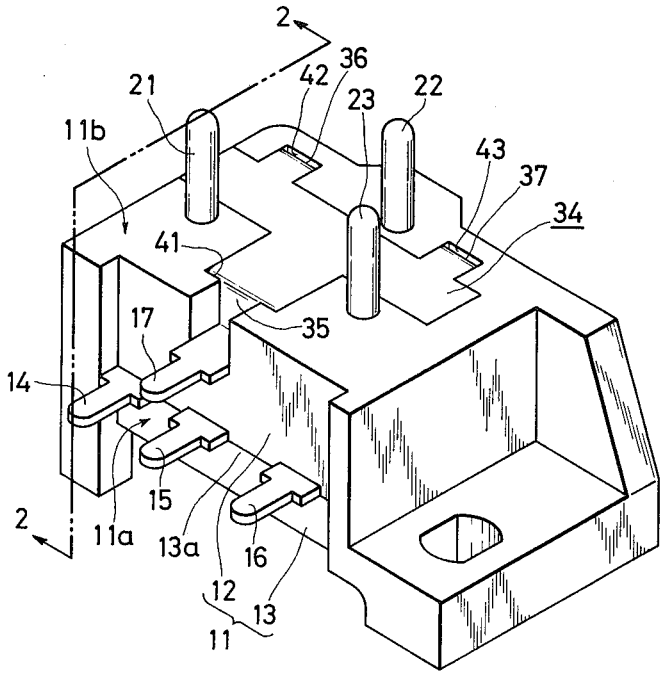
FIG. 1 is a perspective view showing an example of the switch of the present invention.

As shown in FIG. 1, a body 11 of an insulating material is rectangular parallelpipedic in shape and is comprised of a main body 12 and a cover 13 which covers one side (the bottom in FIG. 1) of the main body 12. In this example, three sets of switches are housed in the body 11 and they are connected at one end to a common terminal. In FIG. 1 three terminals 14, 15 and 16 project out forwardly of he front 11*a* of the body 11 and they are arranged in a lateral direction between the main body 12 and the cover 13. A common terminal 17 projects out forwardly of the front 11*a* of the body 11 in opposing relation to the central terminal 15. Projecting out of the top surface 11*b* of the body 11 which adjoins the front thereof, that is, the terminal lead-out face, and is parallel to the plane of arrangement of the terminals 14 to 16, are actuators 21, 22 and 23 which are slidably supported within the body 11.

Figure 2:
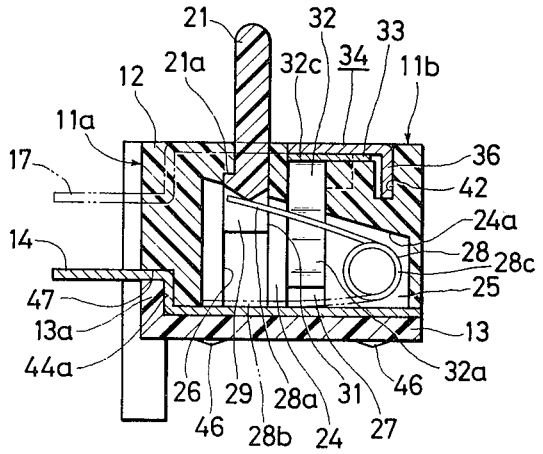
FIG. 2 is a sectional view taken on the line 2—2 in FIG. 1.
Figure 3:
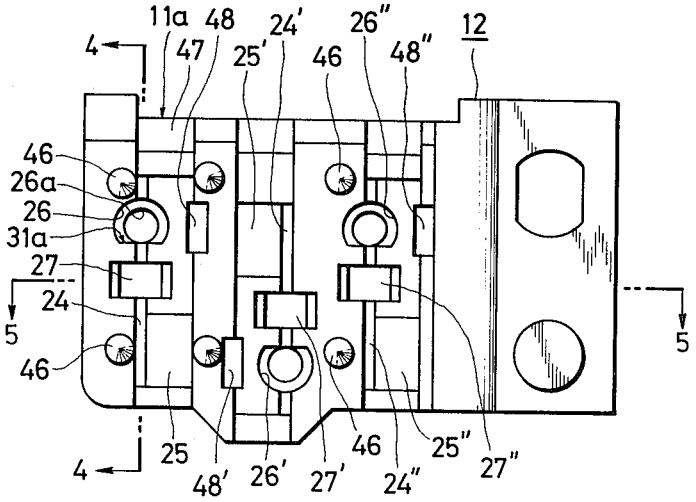
FIG. 3 is a bottom view of a body 12.

The space in the body 11 defined between the terminal 14 and the actuator 21 is used as a switch housing portion. Similarly, the spaces in the body 11 between the terminal 15 and the actuator 22 and between the terminal 16 and the actuator 23 are used as switch housing portions, respectively. The switch housing portions are each provided in the following manner: As shown in FIG. 2 which is a sectional view of FIG. 1, and in FIGS. 3 to 5 which illustrate the main body, a guide groove 24 is formed in the bottom 12*a* of the main body 12 to extend at right angles to the terminal lead-out face 11*a*, and a coil portion housing compartment 25 which is contiguous to the guide groove 24 on the opposite side from the terminal lead-out face 11*a*. At the end of the guide groove 24 is formed an actuator guide portion 26 which extends in a vertical direction in FIG. 2. Between the coil portion housing compartment 25 and the actuator guide portion 26 the guide groove 24 is expanded on both sides to form a clip housing portion 27.

As illustrated in FIG. 2, a coil portion 28*c* of a torsion spring 28 is housed in the coil portion housing compartment 25 and both arms 28*a* and 28*b* of the torsion spring 28 are positioned in the guide groove 24. The arm 28*b* is placed to extend along the surface of the cover 13 but the arm 28*a* extends at an angle to the surface of the cover 13 and the ceiling 24*a* of the guide groove 24 is also sloped to extend along the arm 28*a*.

The actuator 21 is engaged with the free end portion of the arm 28*a* of the torsion spring 28 (FIGS. 2 and 6) so that the spring arm 28*a* may approach the other arm 28*b* by the manipulation of the actuator 21. The actuator 21 is pin-shaped in this example and has its inner end positioned in the actuator guide portion 26 and projects out therefrom through a hole 26*a* (FIGS. 3 and 4) which communicates with the actuator guide portion 26 and has a smaller diameter than does the latter. The inner end portion of the actuator 21 has a larger-diameter flange 21*a* for engagement with a stepped portion between the actuator guide portion 26 and the small hole 26*a* to prevent the actuator 21 from coming off the actuator guide portion 26. A slit 29 (FIGS. 2 and 6) is formed in the inner end face of the flange 21*a* for receiving the free end portion of the arm 28*a* of the torsion spring 28 to provide engagement between the actuator 21 and the arm 28*a*. Accordingly, when the actuator 21 is depressed into the body 11, the spring arm 28*a* is urged towards the spring arm 28*b*. The peripheral surface of the flange 21*a* of the actuator 21 is partly cut off in parallel to its axis to provide a flat surface 31 (FIG. 6) and the peripheral surface of the actuator guide portion 26 for contact with the flat surface 31 is also made flat as indicated by 31*a* (FIG. 3), permitting the actuator 21 to be guided up and down in the body 11 but preventing it from rotational movement.

Figure 4:
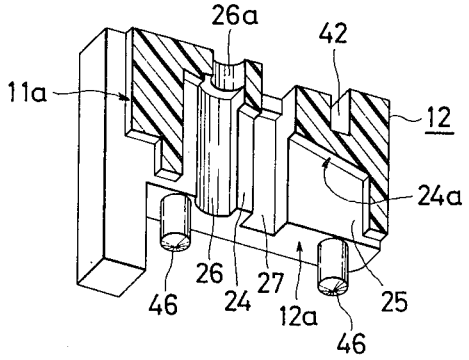
FIG. 4 is a perspective view of a section taken on the line 4—4 in FIG. 3.
Figure 5:
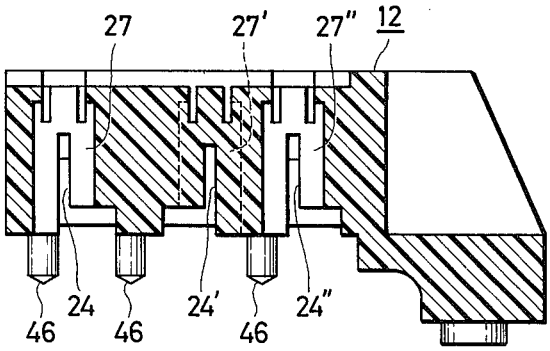
FIG. 5 is a sectional view taken on the line 5—5 in FIG. 3.
Figure 6:
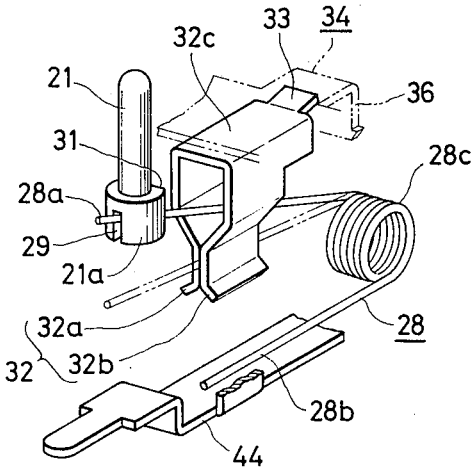
FIG. 6 is a perspective view showing the principal part of the switch of the present invention, with its body taken off.

Between the coil portion 28*c* of the torsion spring 28 and the actuator 21 is disposed a clip 32 as a fixed contact piece as shown in FIG. 6. The clip 32 is formed, for instance, by bending a piece of resilient sheet metal into a U-letter shape. The clip 32 is disposed in the clip housing portion 27 as depicted in FIG. 2. The clip housing portion 27 is provided by making a through hole in the main body 12 as illustrated in FIGS. 4 and 5. The free end portions of both leg pieces 32*a* and 32*b* of the clip 32 are bent into resilient contact with each other to form a holding portion as shown in FIG. 6. The holding portion lies between the arms 28*a* and 28*b* of the torsion spring 28 and a coupling portion 32*c* of the two leg pieces 32*a* and 32*b* lies on the opposite side from the cover 13 as shown in FIG. 2 and, further, the surfaces of both leg pieces 32*a* and 32*b* are substantially parallel to the guide groove 24.

Figure 7:
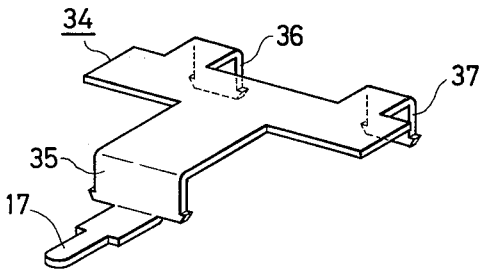
FIG. 7 is a perspective view of the bottom of the portion of a terminal 17.

The clip 32 is connected to the common terminal 17, and the arm 28*b* of the torsion spring 28 is connected to the terminal 14. For example, as shown in FIGS. 2 and 6, a lug 33 is formed integrally with the coupling portion 32*c* of the clip 32 on the opposite side from the actuator 21 and the lug 33 is held adjacent to the top surface of the main body 12 on the side opposite from the cover 13. The common terminal 17 has formed integrally therewith a substantially T-shaped plate portion 34 as shown in FIGS. 1 and 7, and the plate portion 34 is mounted on the top surface 11*b* of the body 11 from which the actuators 21 to 23 project out. The free end portion of the vertical portion of the T-letter shape of the plate portion 34 is placed on the side of the terminal lead-out face 11*a* of the body 11 and is bent to extend in parallel thereto, forming an insertion piece 35. The common terminal 17 is formed by bending forwardly the central portion of the marginal edge of the insertion piece 35. At the edge of the plate portion 34 on the opposite side from the insertion piece 35, insertion pieces 36 and 37 are bent to extend in the same direction. Small pawls are protrusively provided at the ends of both marginal edges of the insertion pieces 35 to 37, ensuring to hold the plate portion 34 on the body 11 when the insertion pieces 35, 36 and 37 are press-fitted into engaging grooves 41, 42 and 43 cut in the top surface 11*b* of the body 11, respectively (see FIG. 1). In consequence, the plate portion 34 and the lug 33 of the clip 32 are brought into contact with each other for electrical connection. To facilitate this contact, it is preferred to slightly bend the lug 33 away from the body 11 for resilient contact with the plate portion 34 as shown in FIG. 6. That portion of the body 11 in which the plate 34 is disposed is slightly depressed to conform to it.

Figure 8:
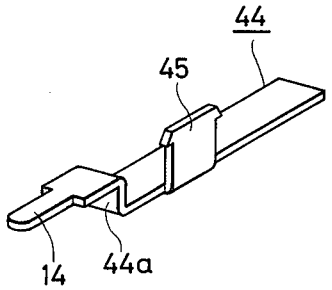
FIG. 8 is a perspective view of the portion of a terminal 14.

As illustrated in FIGS. 2 and 8, the terminal 14 also has a narrow tablet-shaped plate member 44 formed integrally therewith. One end portion of the plate member 44 is bent to the side of projection of the actuators to form an extension 44*a*, which is further bent to the terminal lead-out direction, providing the terminal 14. An insertion piece 45 is bent from one side margin of the plate member 44 to the direction of projection of the actuators, and the insertion piece 45 has small pawls on both sides of its end portion, ensuring to fixedly secure the plate member 44 on the main body 12 in a manner to cover the guide groove 24 when the insertion piece 45 is press-fitted into an engaging groove 48 (see FIG. 3) of the main body 12. Further, the cover 13 is fixedly mounted on the main body 12, for instance, by heat-fusing projecting ends of protrusions 46 of the main body 12 inserted into small holes of the cover 13, by which the plate member 44 is secured on the main body 12. As depicted in FIG. 2, the marginal edge of the cover 13 on the terminal lead-out side is bent towards the actuator projecting side to form a support piece 13*a*, which serves to urge the terminal 14 against a stepped portion 47 of the main body 12 and cooperates with the main body 12 to grip therebetween the extension 44*a* of the plate member 44. The arm 28*b* of the torsion spring 28 extending along the plate member 44 is pressed against it for electrical connection.

Torsion springs, clips and plate members similar to the aforementioned ones 28, 32 and 44 are prepared respectively corresponding to the pair of the terminal 15 and the actuator 22 and the pair of the terminal 16 and the actuator 23, and they are respectively housed in those portions formed in the body 11 in the same manner as the guide groove 24, the coil portion housing compartment 25, the actuator guide portion 26 and the clip housing portion 27. The corresponding housing portions are identified by the same reference numerals but with one and two primes. The order of arrangement of the coil housing compartment 25′, the clip housing portion 27′ and the actuator guide portion 26′ corresponding to the pair of the terminal 15 and the actuator 22 is reverse from that for the pair of the terminal 14 and the actuator 21.

With such an arrangement as described above, for example, when the actuator 21 is pressed into the body 11, the arm 28*a* of the torsion spring 28 is guided by the guide groove 24 towards the arm 28*b* to spread out the leg pieces 32*a* and 32*b* of the clip 32 and is held therebetween as indicated by the broken line in FIG. 6. In consequence, the terminal 14 is electrically connected to the terminal 17 via the plate member 44, the torsion spring 28, the clip 32, the lug 33 and the plate portion 34. Removing the force on the actuator 21, the arm 28*a* is brought out by the spring force of the torsion spring 28 from between the leg pieces 32*a* and 32*b* to move out of contact with the clip 32, disconnecting the terminals 14 and 17.

As described above, according to the present invention, the arms 28*a* and 28*b* of the torsion spring 28 are used both as contact members and as return springs; this permits miniaturization of the switch.

The spring arm 28*a* is gripped between the leg pieces 32*a* and 32*b* of the clip 32 in the vicinity of the arm 28*b* in the state in which the energy stored in the torsion spring 28 is maximum, that is, in the state in which the returning force of the arm 28*a* is the largest. Accordingly, even if the arm 28*a* is gripped by the leg pieces 32*a* and 32*b* under an appropriate pressure so as to achieve good contact between the arm 28*a* and the leg pieces 32*a* and 32*b*, the arm 28*a* is capable of automatically returning to its initial position without being influenced by the action that tends to hinder its return movement by dint of the abovesaid pressure and friction between the leg pieces 32*a* and 32*b* and the arm 28*a*. This allows the reduction of the force for activating the actuator.

Since the actuator acts on one end portion of the arm 28*a* of the torsion spring 28, a large distance of movement (or stroke) of the actuator can be obtained with a small operating force.

Since the clip 32 is disposed between the end portion of the arm 28*a* on which the actuator acts and the base portion or coil portion of the spring 28, the distance from the fulcrum (the coil portion) about which the arm 28*b* is turned by the actuator towards the arm 28*b* to the point of activation of the actuator is long and, accordingly, the operating force needed is small. In addition, in the case of the return movement of the arm 28*a*, the distance between the clip 32 and the fulcrum (the coil portion) is short and the load on the returning force of the arm 28*a* is therefore small, so that the gripping contact pressure on the arm 28*a* by the leg pieces 32*a* and 32*b* can be increased correspondingly.

Further, it is also possible, with the abovesaid arrangement, to reduce the stress which is imposed on the torsion spring by the activation of the actuator and, accordingly, the torsion spring is difficult to fatigue. Moreover, since the spring arm 28*a* makes sliding contact with the leg pieces 32*a* and 32*b*, their contact surfaces make good contact with each other and is long-life.

Figure 9A:
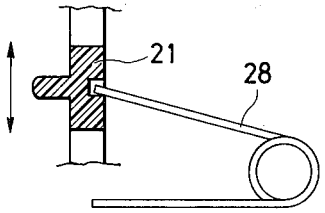
FIGS. 9A and 9B are sectional views respectively illustrating other embodiments of the switch of the present invention.
Figure 9B:
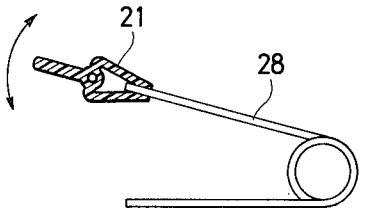

The actuator may also be of a slide type such as shown in FIG. 9A, and of a toggle type such as shown in FIG. 9B. The clip 32 need not always be limited specifically to the type wherein both leg pieces 32*a* and 32*b* are used as contact pieces, but it may also be so arranged that the arm 28*a* is resiliently held between the contact piece corresponding to one of the clip leg pieces and one portion of the body. In this case, it is also possible to adopt an arrangement wherein the intermediate portion of the arm 28*a* moves on the contact pieces for resilient contact therewith. The common terminal 17 may also be replaced with individual terminals for the switches. The number of switches that are housed in the body is not limited specifically to three but it may also be one. It will be evident that the switch structure of the present invention can be employed for purposes other than detection of the closure or opening of small holes in tape cassettes.

Figure 10:
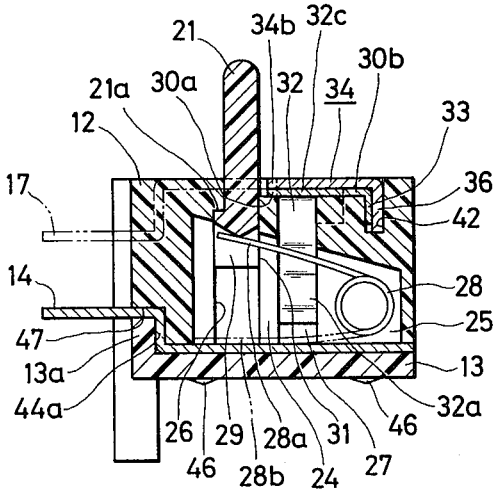
FIG. 10 is a sectional view, corresponding to FIG. 2, showing another example of the connection between a clip 32 and the terminal 17.
Figure 11:
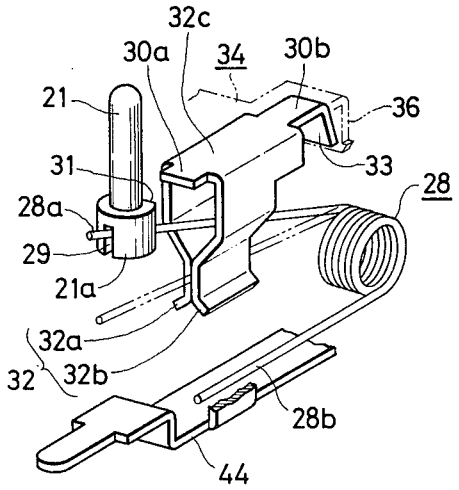
FIG. 11 is a perspective view, corresponding to FIG. 6, showing the clip 32 depicted in FIG. 10.

The clip 32 and the common terminal 17 may also be interconnected in a manner such as shown in FIGS. 10 and 11. That is, as shown in FIG. 11, a support piece 30*b* is extended from the coupling portion 32*c* of the clip 32 on the opposite side from the actuator 21, and the free end portion of the support piece 30*b* is bent towards the coiled spring 28 to form the lug 33, which is forced into the engaging groove 42, along with the insertion piece 36 of terminal 17 as shown in FIG. 10. It is preferred that the lug 33 be bent at an angle smaller than 90° as shown in FIG. 11, thereby ensuring resilient contact of the lug 33 with the surface of the insertion piece 36 when they are inserted into the engaging groove 42. When the clip 32 and the plate member 34 are thus electrically connected, even if the assembled plate member 34 happens to form a space between it and the coupling portion 32*c* of the clip 32, the clip 32 and the plate member 34 would be held in good contact with each other.

Figure 12:
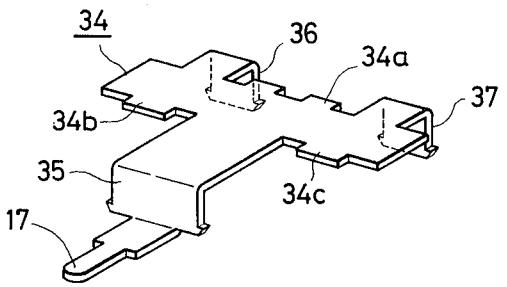
FIG. 12 is a perspective view of the bottom of the portion of the terminal 17 of FIG. 10.

By extending a support piece 30*a* from the coupling portion 32*c* of the clip 32 on the side of the actuator 21 and urging the support pieces 30*a* and 30*b* against the top surface of the body 11 on both sides of the opening of the clip housing portion 27 as illustrated in FIGS. 10 and 11, the clip 32 is supported at both ends and hence is not tilted by the manipulation of the actuator and stably held in its normal position. In this case, a holding portion 34*b* is extended from the plate member 34, by which the support piece 30*a* can be held on the body 11 as shown in FIGS. 10 and 12. Incidentally, holding portions 34*a* and 34*c* in FIG. 12 are used to hold the clips disposed in the clip housing portions 27′ and 27″, respectively.

It will be apparent that many modifications and variations may be effected without departing from the scope of the novel concepts of the present invention.

What is claimed is:

1. A miniature switch comprising:

a body of an insulating material;

a torsion spring made of a conductive material and held in the body;

an actuator engaged with the free end portion of a first arm of the torsion spring and held in the body in a manner to be movable in the direction in which the first arm is moved towards a second arm of the torsion spring;

a first terminal connected to the second arm of the torsion spring and fixed to the body;

a fixed contact piece held in the body between the base portion of the torsion spring and the actuator and between the first and second arms of the torsion spring, for making resilient contact with the first arm brought towards the second arm; and a second terminal electrically connected to the fixed contact piece and fixed to the body.

2. A miniature switch according to claim 1, wherein the fixed contact piece is a clip formed by bending a resilient sheet metal into a U-letter shape; the free end portions of both leg pieces of the clip make resilient contact with each other; the contact portions of both leg pieces are positioned between the first and second arms of the torsion spring; the first arm of the torsion spring is positioned between the contact portions of both leg pieces of the clip and a coupling portion of the clip without making contact therewith; the leg pieces of the clip are held substantially in parallel to the direction of extension of the first and second arms of the torsion spring; and the first arm of the torsion spring moved by the actuator is inserted between the contact portions of the both leg pieces.

3. A miniature switch according to claim 1, wherein the body is comprised of a main body and a cover fixedly mounted on one side thereof; a guide groove is cut in the surface of the body on the side of the cover; the main body has formed therein a coil portion housing compartment communicating with one end of the guide groove, an actuator guide portion at the other end of the guide groove and a clip housing portion formed by widening the guide groove between the coil housing compartment and the actuator guide portion; and the coil portion of the torsion spring, the first arm of the torsion spring, the actuator and the clip are disposed in the coil portion housing compartment, the guide groove, the actuator guide portion and the clip housing portion, respectively.

4. A miniature switch according to claim 3, wherein the actuator guide portion is formed in the main body to extend therethrough to the side opposite from the cover; the actuator is inserted into the actuator guide portion in a manner to project out from the body on the opposite side from the cover; the inner end face of the actuator has formed therein a slit for engagement with the free end portion of the first arm of the torsion spring; the actuator is biased by the first arm in the direction in which to get out of the body; and means is provided for preventing the actuator from coming off the body against the biasing force of the first arm.

5. A miniature switch according to claim 3, wherein the actuator is held in a manner to be slidable along one side of the body in the actuator guide portion, and wherein a manipulating portion of the actuator projects out of that side of the body.

6. A miniature switch according to claim 3, wherein the actuator is rotatably held in the actuator guide portion, partly projecting out of the body.

7. A miniature switch according to claim 3, wherein the clip housing portion is formed in the body to extend therethrough to the side opposite from the cover; a support piece is extended from a coupling portion of the clip and held on the body on the side opposite from the cover; a plate member formed integrally with the second terminal is fixed to the body to secure thereon the support piece; and the clip and the second terminal are electrically connected to each other.

8. A miniature switch according to claim 7, wherein a lug formed integrally with the support piece is extended slightly aslant away from the body and is held in resilient contact with the surface of the plate member.

9. A miniature switch according to claim 7, wherein a lug formed integrally with the support piece is bent substantially at right angles thereto to the side of the body; an insertion piece formed integrally with the plate member is bent substantially at right angles to the side of the body; and the lug and the insertion piece are held together and inserted into an engaging groove cut in the body.

10. A miniature switch according to claim 7, wherein a second support piece is extended from the coupling portion of the clip on the opposite side from the support piece and is also held by the plate member on the body, holding the clip stably.

11. A miniature switch according to claim 3, wherein a plate member formed integrally with the first terminal is held by the cover on the main body and makes resilient contact with the second arm of the torsion spring, electrically connecting the second arm and the first terminal.

12. A miniature switch according to claim 3, wherein a plurality of said guide grooves are cut substantially in parallel in the main body of the body; the coil portion housing compartment, the actuator guide portion and the clip housing portion are provided to each of the guide grooves; and the coil portions of individual torsion springs, actuators, clips and first arms of the torsion springs are respectively disposed in the coil portion housing compartments, the actuator guide portions, the clip housing portions and the guide grooves, thereby providing a plurality of switches on the body.

13. A miniature switch according to claim 12, wherein each clip housing portion is formed in the main body to extend therethrough to the side opposite from the cover; a support piece is extended from the coupling portion of each clip and held on the main body on the opposite side from the cover; a common metal plate is mounted on the body to secure thereon the support pieces; the second terminal formed integrally with the metal plate is led out as a common terminal; and the second arm of each torsion spring has connected thereto each first terminal.

14. A miniature switch according to claim 12 wherein said plurality of switches are disposed in side by side relation to one another, the coil portion housing compartments, the actuator guide portions and the clip housing portions relative to each guide groove for each adjacent pair of said plurality of switches being oriented in opposite directions to one another.

* * * * *